US011823825B2

(12) United States Patent
Orimo

(10) Patent No.: US 11,823,825 B2
(45) Date of Patent: Nov. 21, 2023

(54) METAL MAGNETIC POWDER AND METHOD FOR MANUFACTURING SAME, AS WELL AS COIL COMPONENT AND CIRCUIT BOARD

(71) Applicant: TAIYO YUDEN CO., LTD., Tokyo (JP)

(72) Inventor: Yoko Orimo, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 44 days.

(21) Appl. No.: 17/370,765

(22) Filed: Jul. 8, 2021

(65) Prior Publication Data

US 2022/0037066 A1 Feb. 3, 2022

(30) Foreign Application Priority Data

Jul. 31, 2020 (JP) ..... 2020-130056

(51) Int. Cl.

| | |
|---|---|
| ***H01F 1/147*** | (2006.01) |
| ***H01F 27/255*** | (2006.01) |
| ***C22C 38/34*** | (2006.01) |
| ***B22F 1/142*** | (2022.01) |
| ***B22F 1/06*** | (2022.01) |
| *B22F 1/16* | (2022.01) |

(52) U.S. Cl.

CPC ..... *H01F 1/147* (2013.01); *B22F 1/06* (2022.01); *B22F 1/142* (2022.01); *C22C 38/34* (2013.01); *H01F 27/255* (2013.01); *B22F 2301/35* (2013.01); *B22F 2302/25* (2013.01); *C22C 2202/02* (2013.01); *Y10T 428/32* (2015.01)

(58) Field of Classification Search

None

See application file for complete search history.

(56) References Cited

U.S. PATENT DOCUMENTS

| | | | | |
|---|---|---|---|---|
| 4,360,377 | A * | 11/1982 | Steck | H01F 1/09 427/127 |
| 11,371,122 | B2 * | 6/2022 | Orimo | C22C 33/0264 |
| 11,615,902 | B2 * | 3/2023 | Orimo | C22C 38/06 336/200 |
| 11,680,306 | B2 * | 6/2023 | Orimo | B22F 1/145 148/307 |
| 2011/0267167 | A1 * | 11/2011 | Ogawa | C22C 1/02 148/284 |
| 2017/0018343 | A1 * | 1/2017 | Nishimura | H01F 1/24 |
| 2019/0198210 | A1 * | 6/2019 | Suzuki | H01F 17/0013 |
| 2019/0279801 | A1 * | 9/2019 | Yoshidome | H01F 1/33 |

(Continued)

FOREIGN PATENT DOCUMENTS

| | | | |
|---|---|---|---|
| JP | 2011249774 | A | 12/2011 |
| JP | 2015126047 | A | 7/2015 |
| JP | 2020070499 | A | 5/2020 |

*Primary Examiner* — Kevin M Bernatz

(74) *Attorney, Agent, or Firm* — Law Office of Katsuhiro Arai

(57) ABSTRACT

A metal magnetic powder is constituted by metal magnetic grains that each include: a metal phase where the percentage of Fe at its center part is 98 percent by mass or higher, while the mass percentage of Fe at its contour part is lower than that at the center part; and an oxide film covering the metal phase, so as to inhibit oxidation of Fe contained in the metal phase, despite the high content percentage of Fe in the metal phase.

9 Claims, 7 Drawing Sheets

(56) References Cited

U.S. PATENT DOCUMENTS

| | | | | |
|---|---|---|---|---|
| 2020/0312503 | A1* | 10/2020 | Tanada | H01F 1/24 |
| 2020/0381152 | A1* | 12/2020 | Utsuno | B22F 9/082 |
| 2021/0035719 | A1* | 2/2021 | Mori | H01F 1/33 |
| 2021/0350962 | A1* | 11/2021 | Hanada | C22C 45/02 |
| 2022/0005636 | A1 | 1/2022 | Kawauchi et al. | |
| 2022/0037067 | A1* | 2/2022 | Orimo | C22C 38/18 |
| 2022/0254553 | A1* | 8/2022 | Nakazawa | H01F 1/24 |
| 2022/0275488 | A1* | 9/2022 | Orimo | B22F 1/145 |
| 2022/0319749 | A1* | 10/2022 | Kumaoka | C22C 38/32 |
| 2022/0392677 | A1* | 12/2022 | Taguchi | H01F 1/20 |
| 2023/0035258 | A1* | 2/2023 | Inoguchi | H01F 1/15366 |

* cited by examiner

Cross-Section A-A

METAL MAGNETIC POWDER AND METHOD FOR MANUFACTURING SAME, AS WELL AS COIL COMPONENT AND CIRCUIT BOARD

CROSS-REFERENCE TO RELATED APPLICATIONS

The present application claims priority to Japanese Patent Application No. 2020-130056, filed Jul. 31, 2020, the disclosure of which is incorporated herein by reference in its entirety including any and all particular combinations of the features disclosed therein.

BACKGROUND

Field of the Invention

The present invention relates to a metal magnetic powder and a method for manufacturing the same, as well as a coil component and a circuit board.

Description of the Related Art

In recent years, the drive for smaller, higher-performance mobile phones and other high-frequency communication systems is requiring the electronic components installed therein to be also smaller and higher in performance. This is creating a demand for inductors and other coil components that are not only smaller in size, but also higher in current flow. To achieve these requirements, metal magnetic materials that are more resistant to magnetic saturation than ferrite materials are beginning to be adopted as the magnetic materials for use in coil components. In this application, an insulating film is formed on the surface of the grains that constitute the magnetic metal materials in order to improve their electrical insulating properties that are poorer than those of the ferrite materials.

As a method for forming an insulating film on the surface of metal magnetic material grains, Patent Literature 1 discloses forming Fe—Si—Cr-based soft magnetic alloy powder grains by coating or depositing TEOS, colloidal silica, or other Si compound on their surface, and then heat-treating the grains in the air to cause them to bond together via insulating oxide layers.

Also, Patent Literature 2 discloses heat-treating in the air formed soft magnetic alloy grains containing iron, silicon, and an element that oxidizes more easily than iron, in order to produce insulating oxidized layers constituted by metal oxides on the surface of the grains and cause them to bond together via the oxidized layers.

BACKGROUND ART LITERATURES

[Patent Literature 1] Japanese Patent Laid-open No. 2015-126047

[Patent Literature 2] Japanese Patent Laid-open No. 2011-249774

SUMMARY

Forming oxide films or oxide layers through heat treatment as mentioned above can, depending on the heat treatment conditions, promote oxidation of Fe which is the primary component of metal magnetic materials and thereby lower their magnetic properties. This problem becomes prominent when metal magnetic materials of high Fe content percentages are used for the purpose of obtaining magnetic bodies offering excellent magnetic properties.

Accordingly, obtaining a magnetic body offering excellent magnetic properties by forming oxide films or oxide layers through heat treatment, requires the content percentage of Fe in the metal magnetic material to be increased while at the same time inhibiting oxidation of Fe in the metal magnetic material. However, cases of achieving both have not been reported to date.

The present invention was developed in light of the aforementioned problems and its object is to provide a metal magnetic powder that, despite a high content percentage of Fe in the metal phase inside the metal magnetic grain, inhibits oxidation of the contained Fe to allow a magnetic body offering excellent magnetic properties to be obtained.

Following the various studies conducted to solve the aforementioned problems, the inventor of the present invention found that the aforementioned problems could be solved by making sure the metal phase in the metal magnetic grains constituting the metal magnetic powder is such that the content percentage of Fe is high at the center part but low at the contour part near the surface, and consequently completed the present invention.

To be specific, the first aspect of the present invention to solve the aforementioned problems is a metal magnetic powder constituted by metal magnetic grains that each comprise: a metal phase where the percentage of Fe at its center part is 98 percent by mass or higher, while the mass percentage of Fe at its contour part is lower than that at the center part; and an oxide film covering the metal phase.

Additionally, the second aspect of the present invention is a method for manufacturing a metal magnetic powder, which includes: preparing a material powder for metal magnetic material whose Fe content is 90 to 99 percent by mass and which contains at least one type of element that oxidizes more easily than Fe in the air; placing the material powder in an atmosphere of 5 to 10 ppm in oxygen concentration, and raising its temperature to 850° C. at a rate of rise in temperature of 100° C./min or higher; and heat-treating the material powder in the atmosphere at a temperature of 850° C. or above but below 1000° C. for 5 to 10 minutes.

Additionally, the third aspect of the present invention is a coil component comprising: a magnetic body in which the metal magnetic grains constituting the metal magnetic powder pertaining to the aforementioned first aspect are joined together via a resin or oxide; and conductors placed inside, or on the surface of, the magnetic body.

Furthermore, the fourth aspect of the present invention is a circuit board on which the coil component pertaining to the aforementioned third aspect is installed.

According to the present invention, a metal magnetic powder can be provided that, despite a high content percentage of Fe in the metal phase inside the metal magnetic grains, inhibits oxidation of the contained Fe to allow a magnetic body offering excellent magnetic properties to be obtained.

BRIEF DESCRIPTION OF THE DRAWINGS

(FIG. 4A: General perspective view, FIG. 4B: View of cross-section A-A in FIG. 4A)

(FIG. 6A: General perspective view, FIG. 6B: View of cross-section B-B in FIG. 6A)

DESCRIPTION OF THE SYMBOLS

Figure 1:
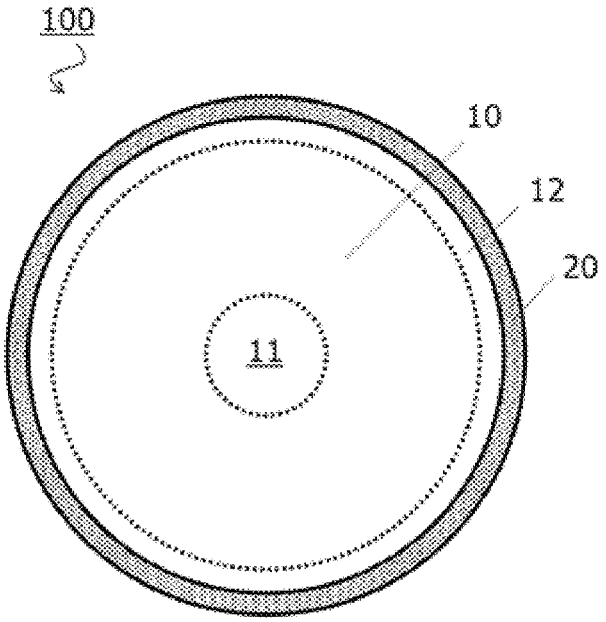
FIG. 1 is an explanatory drawing illustrating the cross-section structure of a metal magnetic grain constituting a metal magnetic powder pertaining to an aspect of the present invention.

100 Metal magnetic grain
10 Metal phase
11 Center part
12 Contour part
20 Oxide film
$E_1$, $E_2$ End point of analysis target line
L Length of analysis target line

DETAILED DESCRIPTION OF EMBODIMENTS

The constitutions as well as operations and effects of the present invention are explained below, together with the technical ideas, by referring to the drawings. It should be noted, however, that the mechanisms of operations include estimations, and whether they are right or wrong does not limit the present invention in any way. Also, of the components in the aspects below, those not described in the claims representing the most generic concepts are explained as optional components. It should be noted that a description of numerical range (description of two values connected by "to") is interpreted to include the described values as the lower limit and the upper limit in some embodiments, and in other embodiments, the lower limit and/or the upper limit can be exclusive in the range.

[Metal Magnetic Powder]

The metal magnetic powder pertaining to the first aspect of the present invention (hereinafter also referred to simply as "first aspect") is constituted by metal magnetic grains that each comprise: a metal phase where the percentage of Fe at its center part is 98 percent by mass or higher, while the percentage of Fe at its contour part is lower than that at the center part; and an oxide film covering the metal phase.

As shown in FIG. 1, the metal magnetic grains 100 constituting the first aspect each comprise a metal phase 10 and an oxide film 20 formed on, and covering, the surface thereof. For the purpose of a composition analysis in a depth/radial direction of the metal phase 10 of the metal magnetic grain 100, the center part 11 and the contour part 12 are defined in an exemplary embodiment as follows: The center part 11 is a region extending radially from a center of the metal phase 10 outwardly to a radius of about 10% of the radius of the metal phase 10, and the contour part 12 is a region extending radially in depth from an outermost surface of the metal phase 10 to a depth of about 4% of the radius/depth of the metal phase 10.

The metal phase 10 is such that the mass percentage of Fe relative to the contained metal elements is 98 percent by mass or higher at the center part 11. Also, at the contour part 12 positioned immediately on the inner side of the oxide film 20, the mass percentage of Fe relative to the contained metal elements is lower than the percentage at the center part 11. Since, geometrically, the center part 11 of the metal phase 10 is where many magnetic fluxes will be passing through when a magnetic body is formed, a magnetic body offering excellent magnetic properties such as magnetic saturation properties can be obtained when the percentage of Fe at this part is high. On the other hand, geometrically, the contour part 12 of the metal phase 10 will have fewer magnetic fluxes passing through it compared to the center part 11, and therefore a low percentage of Fe here will have limited negative effects on magnetic properties. Furthermore, the contour part 12, being positioned near the surface of the metal magnetic grain, is susceptible to changes in the storage environment and use environment, particularly changes in temperature and humidity, and thus can cause problems of dropping magnetic properties due to oxidation of the contained Fe while the metal magnetic powder is stored, when it is handled during the course of manufacturing of coil components, and when the coil components are used. Accordingly, further oxidation of the contour part 12 can be inhibited when the percentage of Fe is low, while the percentages of other elements are high, at the contour part 12. This means that, when the mass percentage of Fe at the center part 11 is 98 percent by mass or higher, and the mass percentage of Fe at the contour part 12 is lower than that at the center part 11, each part can contribute to the improvement of magnetic properties through different actions, and the resulting magnetic metal powder will allow a magnetic body offering excellent magnetic properties to be obtained. To make the aforementioned multiple actions more significant, the mass percentage of Fe at the contour part 12 is preferably lower by at least 1 percent by mass, or more preferably lower by at least 2 percent by mass, or yet more preferably lower by at least 5 percent by mass, than that at the center part 11. On the other hand, to minimize the drop in magnetic properties due to a decrease in the mass percentage of Fe, the difference between the mass percentage of Fe at the contour part 12 and that at the center part 11 is preferably 20 percent by mass or less, or more preferably 18 percent by mass or less. In a preferred embodiment, the specific mass percentage of Fe at the contour part 12 is 80 to 85 percent by mass, for example. It should be noted that parts where the mass percentage of Fe is lower than at the center part 11 may exist in the depth direction beyond the contour part 12, spanning from the surface of the metal phase 10 and continuing throughout the inside of the metal magnetic grain 100.

In some embodiments, the center part and the contour part (and an intermediate part present therebetween) are not constituted by discrete layers having boundaries, and the metal phase is constituted by a single phase, wherein the mass percentage of Fe changes continuously in a radial direction. In other embodiments, the center part and the contour part (and an intermediate part present therebetween) are constituted by discrete layers having boundaries, and the metal phase is constituted by multiple phases, wherein the mass percentage of Fe changes discontinuously in a radial direction.

Here, the percentages of Fe at the center part 11 and contour part 12 are each determined by the method below. First, the metal magnetic powder is observed with a scanning transmission electron microscope (STEM) (JEM-2100F, manufactured by JEOL Ltd.) equipped with an annular dark-field (ADF) detector and an energy-dispersive X-ray spectroscopy (EDS) detector, to determine a view field containing multiple grains reflecting the granularity distribution of the powder. Here, "grains (in the view field) reflecting the granularity distribution of the (metal magnetic) powder" means eliminating those view fields that show grains all falling on the large grain size side, or on the small grain size side, of the granularity histogram and, so long as roughly equal numbers of grains falling on the large grain size side and grains falling on the small grain size side are contained in the view field (e.g., a number ratio of 4/6 to 6/4), the granularity distribution it represents may be slightly different (e.g., within ±30% as an average grain size) from the granularity distribution of the entire powder.

Next, the circle-equivalent diameter (Heywood diameter) is calculated for each of the metal magnetic grains 100 in the view field and the one having the largest diameter is selected as the observation target grain. It should be noted that, among the metal magnetic grains 100 in the view field, those having an extremely small grain size may be excluded from the candidates for the observation target grain and circle-equivalent diameter calculation may be omitted for these grains. Also, if the metal magnetic grain 100 having the largest diameter in the view field is immediately obvious, the observation target grain may be determined based on this fact and circle-equivalent diameter calculation and comparison may be omitted.

Next, on the observation target grain, a position of the metal phase 10 present on the inner side of the oxide film 20 is identified based on the contrast (brightness) difference in the observed cross-section. It should be noted that, under the present invention, the metal phase 10 is the part where the oxygen abundance ratio is 15 atomic percent or lower when analyzed by the aforementioned STEM-installed EDS, presenting a contrast that permits easy distinction from the oxide film 20 due to a difference in oxygen abundance ratio relative to the oxide film 20 which is an oxide and thus contains a large quantity of oxygen.

Figure 2:
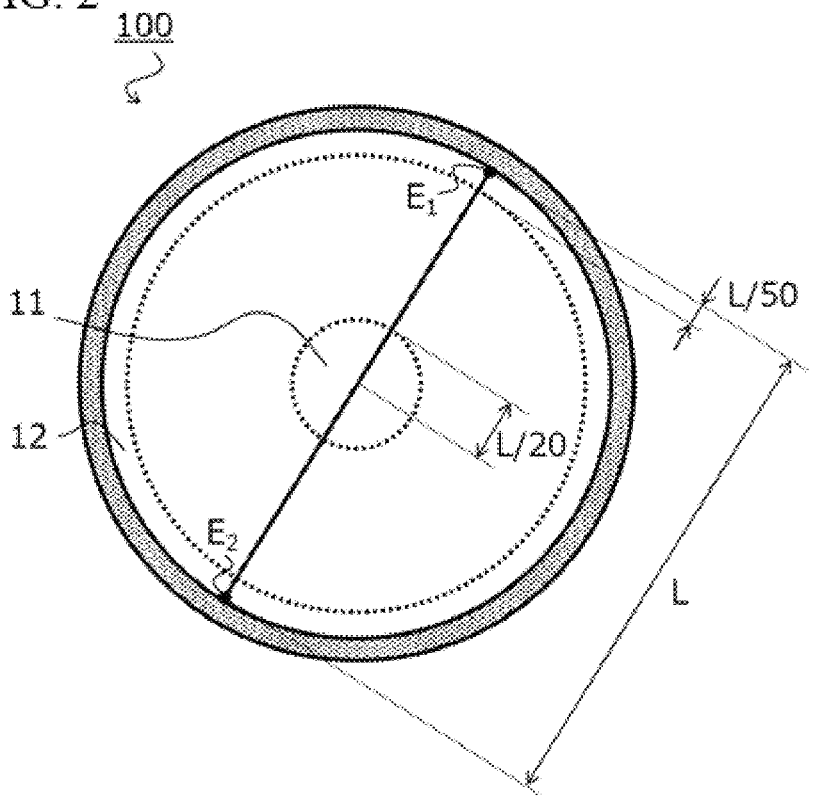
FIG. 2 is an explanatory drawing illustrating how to determine the center part, and the contour part, of the metal phase in a metal magnetic grain constituting a metal magnetic powder pertaining to an aspect of the present invention.

Next, on the identified metal phase 10, one arbitrary (randomly selected) point (point $E_1$) positioned at the boundary with the oxide film 20 is selected and, among the lines having this point as one end point and passing through the metal phase 10, the one with the largest length is determined as the analysis target line, as shown in FIG. 2. At this time, the other end point of the analysis target line is given as point $E_2$ and the length of the line, as L.

Next, the distributions of metal elements along the analysis target line are measured by line analysis to calculate the content percentage of each metal element.

Next, the range of L/20 each direction toward both end points from the midpoint (center point) of the analyzed line is defined as the center part 11 of the metal phase 10, as shown in FIG. 2, and the sum of the mass percentages of Fe at the respective measurement points within this region is divided by the number of the measurement points to calculate the average value, for use as the percentage (percent by mass) of Fe at the center part 11.

Also, the ranges of L/50 from both end points of the analyzed line are defined as the first contour part 12 (on a start-of-measurement end side) and the second contour part 12 (on an end-of-measurement end side), respectively, as shown in FIG. 2, and the sum of the mass percentages of Fe at the respective measurement points within each of these regions is divided by the number of the measurement points to calculate the respective average values, for use as the percentage (percent by mass) of Fe at the first contour part 12 (on the start-of-measurement end side) and that at the second contour part 12 (on the end-of-measurement end side). Then, when the percentages (percent by mass) of Fe at the two contour parts 12 are both lower than that at the center part 11, the mass percentage of Fe at "the contour part 12" is considered lower than that at the center part 11. Also, when the content percentage (percent by mass) of Fe at the center part 11 is different by a prescribed value or more from the corresponding percentage at the first contour part 12 and the corresponding percentage at the second contour part 12, respectively, the content percentage (percent by mass) of Fe at the contour part 12 is considered lower by at least the prescribed value than at the center part 11. When calculating the average value of measurement points within each of the aforementioned regions, the average of five or more measurement points can be deemed a representative value of each such range. If the measured value at each measurement point is greater or smaller by 2 percent by mass or more (i.e., 2 percentage point or more) than the measured value at an adjacent measurement point, the average value of 10 or more measurement points can be used as a reliable representative value of each such range.

Preferably the distribution of Fe in the metal phase 10 is such that the average value of the mass percentages of Fe at the respective measurement points within the range of L/15 each direction toward both end points from the midpoint of the analysis target line is 98 percent by mass or greater, from the viewpoint of obtaining more excellent magnetic properties. The aforementioned range extends more preferably by L/10 each direction, or even more preferably by L/8 each way.

The elements contained in the metal phase 10 other than Fe are not limited so long as a metal magnetic powder, and a coil component, both having prescribed properties, can be obtained; however, preferably an element that oxidizes more easily than Fe in the air (hereinafter also referred to as "element M") is contained. This way, the effects of changes in the storage environment and use environment, particularly changes in temperature and humidity, are mitigated, and oxidation of Fe and drop in magnetic properties resulting therefrom will be effectively inhibited, which is desired. The oxidation-inhibition action becomes prominent when, for example, at least one type of element selected from Si, Cr, Al, Ti, Zr, and Mg is contained.

If at least one type of element selected from Si, Cr, Al, Ti, Zr, and Mg is contained in the metal phase 10, preferably it is present at least at the contour part 12. This way, the electrical resistance of the contour part 12 can be increased so that, when a magnetic body is formed, eddy current loss that would otherwise arise from the magnetic fluxes passing through it can be inhibited. Preferably the total of the percentages of these elements at the contour part 12 is higher by at least 5 percent by mass than the total of such percentages at the center part 11. This way, the aforementioned action of inhibiting eddy current loss becomes prominent, and oxidation of Fe in the metal phase is more effectively inhibited. These actions become more prominent when the percentages of the aforementioned elements at the contour part 12 amount to at least 10 percent by mass in total.

The oxide film 20 covering the metal phase 10 is not limited in composition, thickness, etc., so long as it can electrically insulate the metal phase 10 from other metal phase 10 when a coil component is manufactured using a metal magnetic powder containing the metal magnetic grains 100. The oxide film 20 normally contains element M. This way, permeation of oxygen in the oxide film 20, and oxidation of the constituent elements in the metal phase 10 resulting therefrom, will be inhibited. Preferably at least one type of element selected from Si, Cr, Al, Ti, Zr, and Mg is contained, for example, because this improves not only the aforementioned action of inhibiting oxidation of the constituent elements in the metal phase 10, but also the electrical insulating property of the oxide film 20. Additionally, when two or more types of elements M are contained in the oxide film 20, the metal magnetic powder will achieve higher electrical insulating property, while allowing a magnetic body offering excellent magnetic saturation properties to be obtained. When two or more types of elements M are contained in the oxide film 20, preferably Si is contained as one of them because the metal magnetic powder will have higher electrical insulating property exhibited by its oxide film 20. Furthermore, when the oxide film 20 contains Fe and a part containing more Fe than the total of elements M in mass percentage is formed in the film, the part on the inner side thereof will be protected against the loads resulting from changes in the storage environment and use environment.

Here, the elements contained in the oxide film 20 are identified, and formation of a part containing more Fe than the total of elements M in the oxide film 20 is confirmed, according to the method below. First, an arbitrary metal magnetic grain 100 constituting the metal magnetic powder is measured for the content percentages (atomic percent) of iron (Fe), oxygen (O) and element M on its randomly selected surface using an X-ray photoelectron spectrometer (PHI Quantera II, manufactured by ULVAC-PHI, Inc.), followed by dry etching of the grain surface, and these steps are repeated to obtain the distribution of each element in the depth direction (diameter direction) of the grain. The content percentage of each element is measured using the monochromatized AlKα ray as the X-ray source, by setting the detection region to 100 μmφ, and at depths incremented by 5 nm. Also, regarding the dry etching conditions, argon (Ar) is used as the dry etching gas, and the applied voltage is set to 2.0 kV and the dry etching rate, to approx. 5 nm/min (equivalent $SiO_2$ value).

Next, on the Fe concentration distribution (atomic percent) obtained by the measurement based on X-ray photoelectron spectrometry, the inter-measurement-point section where the concentration difference between the measurement points drops to below 1 atomic percent for the first time, as viewed from the grain surface side, is defined as the boundary between the metal phase 10 and the oxide film 20. It should be noted that, since the position of the boundary between the metal phase 10 and the oxide film 20 as determined by this method roughly matches the boundary determined by the analysis using the aforementioned STEM-installed EDS, either one may be adopted. If the two do not match, however, the result given by the aforementioned STEM-installed EDS is used as the boundary between the metal phase 10 and the oxide film 20 under the present invention.

Next, each measurement point positioned in the oxide film 20, which is a region shallower than the boundary, is checked for elements contained by a quantity (atomic percent) exceeding the detection limit.

Next, for each measurement point positioned in the oxide film 20, the mass percentage (percent by mass) of each element that has been confirmed to be contained is calculated, to obtain its distribution in the film thickness direction. The above operation is performed on three different metal magnetic grains 100, and any element that has been confirmed to be contained in the oxide films 20 of all grains is determined as an element contained in the oxide films 20 of the metal magnetic grains 100 constituting the metal magnetic powder. Additionally, if a measurement point has been confirmed on all of the aforementioned three metal magnetic grains 100 where more Fe is contained than the total of elements M based on mass percentage according to the element distributions in the film thickness direction of the oxide film 20, then it is determined that the metal magnetic powder is constituted by metal magnetic grains whose oxide film 20 has a part formed in it where more Fe is contained than the total of elements M based on mass percentage.

[Method for Manufacturing Metal Magnetic Powder]

The method for manufacturing a metal magnetic powder pertaining to the second aspect of the present invention (hereinafter also referred to simply as "second aspect") includes: preparing a material powder for metal magnetic material whose Fe content is 90 to 99 percent by mass and which contains at least one type of element that oxidizes more easily than Fe in the air; placing the material powder in an atmosphere of 5 to 10 ppm in oxygen concentration and raising its temperature to 850° C. at a rate of rise in temperature of 100° C./min or higher; and heat-treating the material powder in the atmosphere at a temperature of 850° C. or above but below 1000° C. for 5 to 10 minutes.

The material powder contains 90 to 99 percent by mass of Fe, and also contains at least one type of element M. This causes primarily element M to undergo an oxidation reaction on the surface of the metal magnetic grain during the heat treatment described below, triggering a diffusion reaction of element M from the center, to the surface, of the metal magnetic grain. At this time, setting specific heat treatment conditions allows for adjustment of the balance between oxidation reaction and diffusion, whereas causing the oxidation reaction to occur first increases the mass percentage of Fe at the center part, while lowering the mass percentage of Fe at the contour part, of the metal phase. This way, the mass percentage of Fe can be varied at different positions inside the metal magnetic grain. As a result, metal magnetic grains are generated which have an extremely high mass percentage of Fe at the center part, but a relatively low mass percentage of Fe at the contour part, of their metal phase. And, this makes it possible to obtain, from the resulting metal magnetic powder, a magnetic body that offers excellent magnetic properties.

The material powder is placed in an atmosphere of 5 to 10 ppm in oxygen concentration prior to the heat treatment described below. And, it remains in this atmosphere until the heat treatment is complete and the material powder is cooled to at least 500° C. or below. Setting the oxygen concentration in the atmosphere to 5 ppm or higher increases the quantity of element M that will oxidize at the metal magnetic grain surface during the heat treatment described below, which also increases the quantity of element M that will diffuse from the inside, to the surface, of the metal magnetic grain. As a result, the mass percentage of Fe can be increased at the center part, while the mass percentage of Fe can be decreased at the contour part, sufficiently in the metal phase. On the other hand, setting the oxygen concentration in the atmosphere to 10 ppm or lower can inhibit Fe from oxidizing at the metal magnetic grain surface during the heat treatment described below.

The temperature of the material powder is raised to 850° C. at a rate of rise in temperature of 100° C./min or higher in the aforementioned atmosphere. This can inhibit Fe from oxidizing while the temperature is rising. That is because the oxidation reaction of Fe occurs more actively than the oxidation reaction of element M at temperatures lower than 850° C., which means that increasing the rate of rise in temperature and shortening the time during which the material powder is exposed to this temperature inhibits the oxidation reaction of Fe. The rate of rise in temperature is preferably 150° C./min or higher, or more preferably 200° C./min or higher.

After its temperature has been raised to 850° C., the material powder is heat-treated for 5 to 10 minutes at a temperature of 850° C. or above but below 1000° C. Setting the heat treatment temperature at 850° C. or above activates the oxidation reaction of element M at the metal magnetic grain surface, and consequently the quantity of element M diffusing from the inside, to the surface, of the metal magnetic grain also increases. As a result, the mass percentage of Fe can be increased at the center part, while the mass percentage of Fe can be decreased at the contour part, sufficiently in the metal phase, despite a short heat treatment time. The aforementioned oxidation reaction of element M itself that generates the driving force behind the diffusion of element M, is facilitated at 500° C. or above. However, under the second aspect, the oxygen concentration in the atmosphere is extremely low, or 10 ppm or lower, which means that the rate of progression of the oxidation reaction is very slow until 800° C. or so. As a result, the quantity of element M that diffuses from the inside, to the surface, of the metal magnetic grain tends to be insufficient at temperatures of around 500 to 800° C. From the viewpoint of further increasing the difference in the mass percentage of Fe between the center part and the contour part, preferably the heat treatment temperature is set to 900° C. or above. By setting the heat treatment temperature to below 1000° C., on the other hand, oxidation of Fe in the metal phase and consequent diffusion of Fe from the inside, to the surface, of the metal magnetic grain, as well as increase in the mass percentage of Fe at the contour part, can be inhibited. In addition, excessive oxidation of metal elements can be inhibited to allow for formation of a thin oxide film, and the obtained metal magnetic powder can also be manufactured into a magnetic body offering excellent magnetic properties. From the viewpoint of minimizing excessive oxidation of metal elements in the metal phase, preferably the heat treatment temperature is set to 950° C. or below. As for the heat treatment time, setting it to 5 minutes or longer increases the quantity of element M that will diffuse from the inside, to the surface, of the metal magnetic grain, so that the mass percentage of Fe can be increased at the center part, while the mass percentage of Fe can be decreased at the contour part, sufficiently in the metal phase. On the other hand, setting the heat treatment time to 10 minutes or shorter inhibits excessive oxidation of metal elements to allow for formation of a thin oxide film, and the obtained metal magnetic powder can be manufactured into a magnetic body offering excellent magnetic properties. It should be noted that the "heat treatment time" refers to the time during which the metal magnetic powder remains inside the aforementioned heat treatment temperature range. This means that, when the heat treatment temperature is changed within the aforementioned range, the heat treatment time represents the total of the times during which the metal magnetic powder is held at the respective temperatures.

Once the prescribed heat treatment time elapses, the heating is stopped and the metal magnetic powder is let cool as the heating device cools. An example of a cooling method is to lower the temperature inside the heating device to approx. 100° C. or below by means of furnace cooling, or specifically natural cooling that involves letting the heating device stand for a period of time, after which the atmosphere is returned to the air to obtain a metal magnetic powder. Also, rapid cooling may be performed using the rapid cooling mechanism of the heating device in order to increase the rate of cooling and thereby shorten the manufacturing time, or to minimize oxidation of Fe while the temperature is falling. In this case, the rate of cooling is set to 150° C./min or higher between the heat treatment temperature and 200° C., for example. Furthermore, from the viewpoint of further increasing the difference in the mass percentage of Fe between the center part and the contour part in the metal magnetic grains constituting the metal magnetic powder, oxygen may be introduced to the heating device during cooling to selectively oxidize the Fe contained at the contour part and thereby lower the mass percentage of Fe there. At this time, an Fe-rich part is formed on the surface side of the oxide film at the metal magnetic grain surface, to protect the part on the inner side thereof against the impact resulting from changes in the storage environment and use environment. The aforementioned introduction of oxygen to the heating device during cooling is also preferred in that it has the effect of increasing the rate of cooling. An example of oxygen introduction method is to supply oxygen when the temperature of the heating device has dropped to approx. 500° C. to adjust the oxygen concentration in the device to approx. 100 ppm, followed by rapid cooling.

The device with which to achieve the aforementioned atmosphere, rate of rise in temperature, heat treatment temperature, and heat treatment time is not limited, and a vacuum heat treatment furnace, atmosphere furnace, etc., may be used. Also, a rotary kiln furnace, etc., may be used to heat-treat the metal magnetic powder while causing its grains to flow, so as to prevent unwanted sticking or fusing between the metal magnetic grains constituting the metal magnetic powder.

[Coil Component]

The coil component pertaining to the third aspect of the present invention (hereinafter also referred to simply as "third aspect") comprises: a magnetic body in which the metal magnetic grains constituting the aforementioned first aspect are joined together via a resin or oxide; and conductors placed inside, or on the surface of, the magnetic body.

First, an embodiment of the third aspect is explained, which is a coil component comprising: a magnetic body in which the metal magnetic grains constituting the first aspect are joined together via a resin; and conductors placed inside, or on the surface of, the magnetic body.

In this embodiment, the metal magnetic grains forming the magnetic body have the same structure as the metal magnetic grains constituting the aforementioned first aspect, or specifically a structure of an oxide film covering a metal phase where the percentage of Fe at its center part is 98 percent by mass or higher and the mass percentage of Fe at its contour part is lower than that at the center part. This allows the magnetic body to demonstrate excellent magnetic properties so that the coil component equipped with the magnetic body can carry larger current at the same dimensions or it can be made smaller while still carrying the same current.

The shape and dimensions of the magnetic body or material and shape of the conductors are not limited in any way, and may be determined as deemed appropriate according to the required properties.

Figure 3:
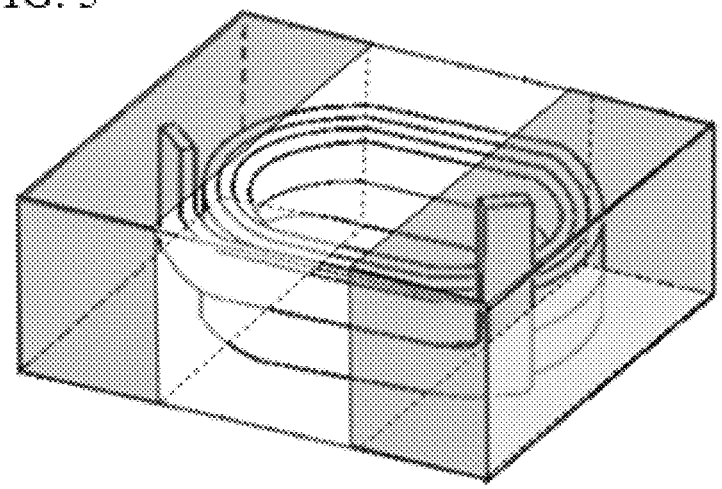
FIG. 3 is an explanatory drawing of a structural example of a composite coil component pertaining to an aspect of the present invention.
Figure 4A:
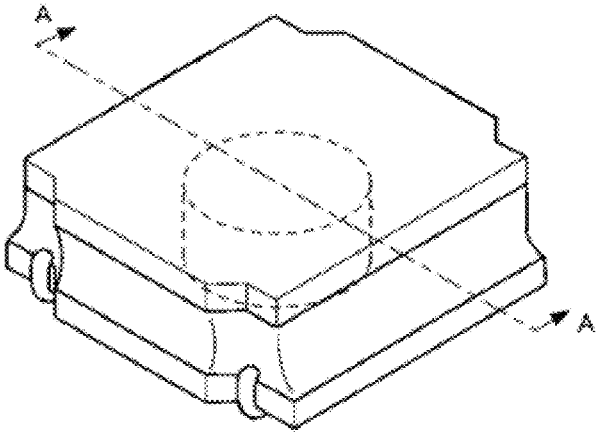
FIGS. 4A and 4B are explanatory drawings of a structural example of a wound coil component pertaining to an aspect of the present invention.
Figure 4B:
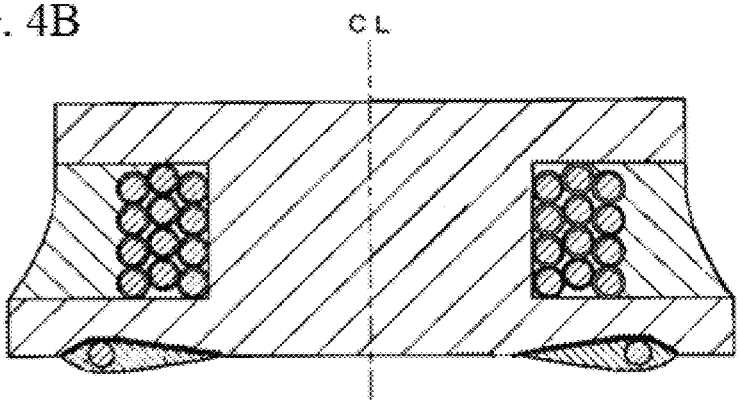
Figure 5:
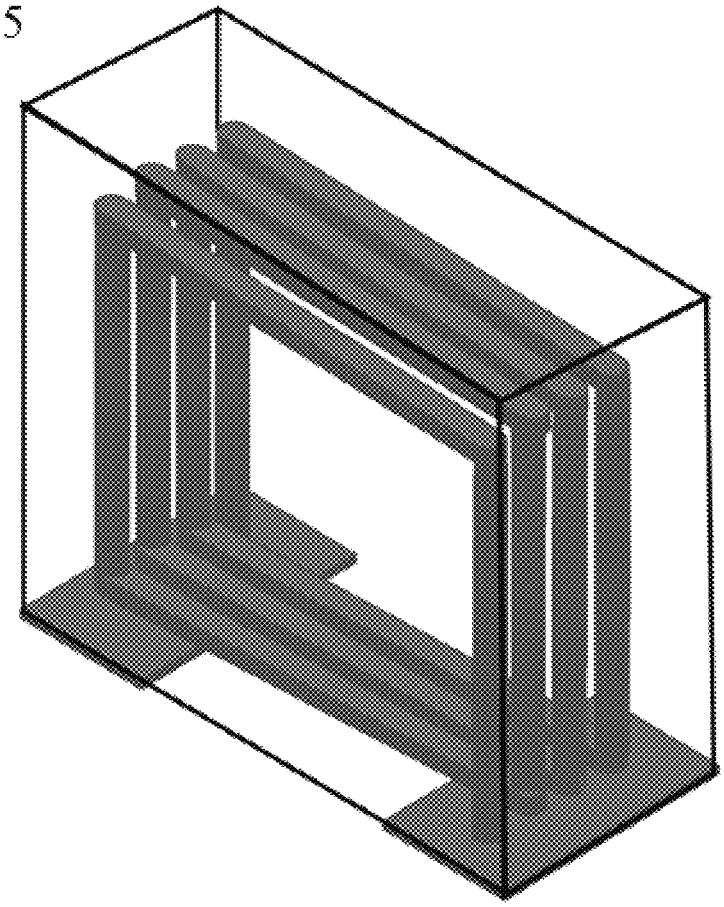
FIG. 5 is an explanatory drawing of a structural example of a thin-film coil component pertaining to an aspect of the present invention.

Embodiments of the third aspect include a composite coil component as shown in FIG. 3, a wound coil component as shown in FIGS. 4A and 4B, and a thin-film coil component as shown in FIG. 5, and the like.

As for the method for manufacturing a coil component pertaining to any such embodiment, typically a composite coil component, for example, is obtained by mixing the metal magnetic powder pertaining to the first aspect with a resin to prepare a mixture, and then pouring the mixture into a die or other mold in which a hollow coil has been placed beforehand, followed by press-forming and curing of the resin.

The resin used is not limited in type so long as it can bond together the metal magnetic grains constituting the metal magnetic powder to form them into a shape and retain the shape, and epoxy resin, silicone resin, or any of various other resins may be used. The use quantity of the resin is not limited, either, and may be 1 to 10 parts by mass relative to 100 parts by mass of the metal magnetic powder, for example.

There is no limitation, either, on how the metal magnetic powder should be mixed with the resin and the mixture poured into the mold, and a method of kneading the two into a liquid mixture and then pouring it into the mold, or a method of pouring into the mold a granulated powder constituted by the metal magnetic grains whose surface has been coated with the resin, may be adopted, for example. Also, as a way of combining the pouring of the mixture into the mold with the press-forming described below, a method of forming the mixture into a sheet shape and then introducing it into the mold through a press, may be adopted.

The press-forming temperature and pressure are not limited, either, and may be determined as deemed appropriate according to the material and shape of the hollow coil placed inside the die, fluidity of the poured metal magnetic powder, type and quantity of the poured resin, and the like.

The temperature at which to cure the resin may also be determined as deemed appropriate according to the resin used. The resin may be cured under a general temperature condition, such as 150 to 300° C. At these temperatures, the composition of the metal magnetic powder pertaining to the first aspect hardly changes.

Also, when the third aspect is a wound coil component, it can be obtained by winding a coil around a magnetic body obtained by the same method used for the aforementioned composite coil component, except that the mixture is poured into the mold without placing a hollow coil in it.

Next, another embodiment of the third aspect is explained, which is a coil component comprising: a magnetic body in which the metal magnetic grains constituting the first aspect are joined together via an oxide; and conductors placed inside, or on the surface of, the magnetic body.

Figure 6A:
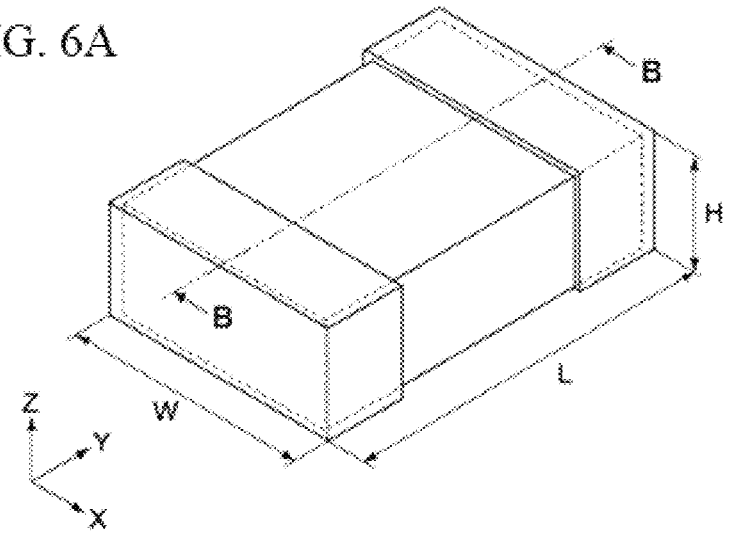
FIGS. 6A and 6B are explanatory drawings of a structural example of a multilayer coil component pertaining to an aspect of the present invention.
Figure 6B:
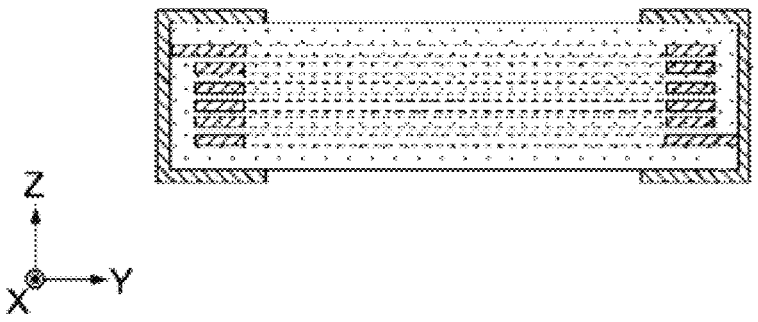

In this embodiment, the metal magnetic powder pertaining to the first aspect is formed and then heat-treated in the presence of oxygen to generate an oxide on the surface of the metal magnetic grains constituting the metal magnetic powder, so that the metal magnetic grains are joined together via the oxide into a magnetic body. In this case, preferably the heat treatment is performed in an atmosphere of 100 ppm or higher in oxygen concentration at a temperature of 600 to 800° C. Setting the oxygen concentration in the heat treatment atmosphere to 100 ppm or higher, which is higher than 5 to 10 ppm in the heat treatment atmosphere under the second aspect, causes element M contained in the oxide films on the metal magnetic grains in the formed body to produce an oxide where the oxide films are contacting each other, and the metal magnetic grains are joined together via this oxide. Accordingly, heat-treating the formed body does not significantly change the composition of the metal phase of the metal magnetic grains. Such coil component, too, can carry larger current or permit size reduction as a result of the magnetic body demonstrating excellent magnetic properties due to the presence of the metal phase which reflects the element distributions in the metal magnetic grains constituting the first aspect and whose center part has an extremely high mass percentage of Fe. Such coil component may be, for example, a thin-film coil component as shown in FIG. 5, or a multi-layer coil component as shown in FIGS. 6A and 6B, and the like.

[Circuit Board]

The circuit board pertaining to the fourth aspect of the present invention (hereinafter also referred to simply as "fourth aspect") is a circuit board on which the coil component pertaining to the aforementioned third aspect is installed.

The circuit board is not limited in structure, etc., and any circuit board suitable for the purpose may be adopted.

The fourth aspect can demonstrate higher performance and permit size reduction by using the coil component pertaining to the third aspect.

EXAMPLES

The present invention is explained more specifically below using an example; however, the present invention is not limited to this example.

Example 1

(Manufacturing of Metal Magnetic Powder)

A material powder for metal magnetic material having a composition of 96.5 percent by mass of Fe, 2.5 percent by mass of Si, and 1 percent by mass of Cr, where the total of Fe, Si, and Cr represents 100 percent by mass, as well as having an average grain size of 4 μm, was placed in a vacuum heat treatment furnace. Next, the interior of the furnace was evacuated to an oxygen concentration of 6 ppm, after which the temperature was raised to 900° C. at a rate of rise in temperature of 200° C./min and then held for 5 minutes to provide heat treatment, followed by rapid cooling to near room temperature through operation of the rapid cooling mechanism of the vacuum heat treatment furnace, to obtain the metal magnetic powder pertaining to Example 1.

(Mass Percentage Measurement of Metal Elements in Metal Phase)

Figure 7:
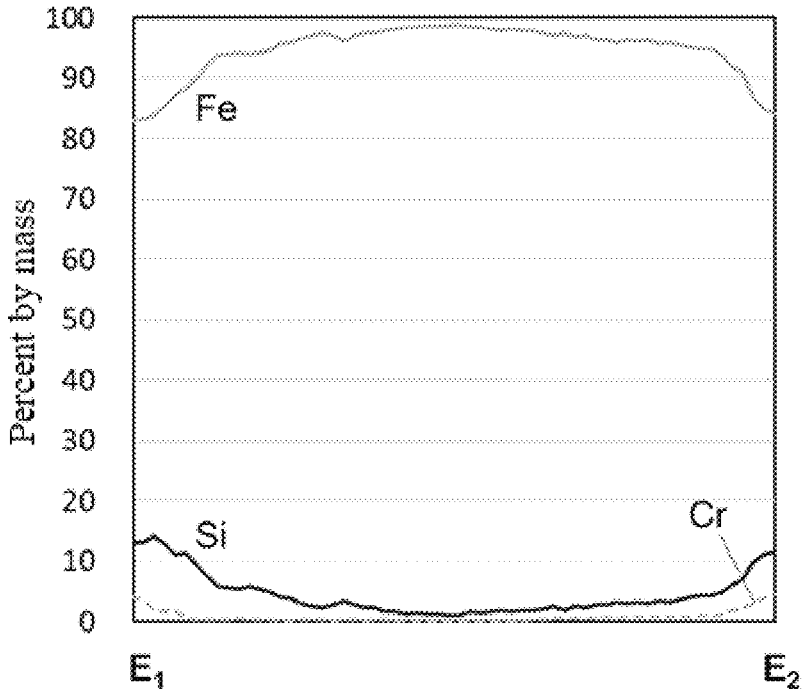
FIG. 7 is a graph obtained from line analysis of a cross-section of a metal magnetic grain constituting the metal magnetic powder pertaining to Example 1, showing the distributions of elements in the metal phase.

When the obtained metal magnetic powder was observed with a STEM according to the method described above, it was confirmed that the observation target grain had its metal phase covered with an oxide film. A line analysis was performed on this metal phase of the observation target grain according to the method described above, to calculate the content percentages of metal elements at each measurement point. The obtained results are shown in FIG. 7 as metal element distributions in the metal phase. Due to the view fields of the STEM, the figure presents the line analysis results in the respective view fields as continuous line analysis data. The positions along the horizontal axis in the figure correspond to the positions along the lines resulting from the line analysis, where "$E_1$" and "$E_2$" correspond to the positions denoted by the corresponding symbols in FIG. 2, or specifically the boundaries of the metal phase with the oxide film.

From the obtained metal element distributions, the mass percentages of each element at the center part and contour part of the metal phase were calculated according to the method described above. The mass percentage of Fe was 98.7 percent by mass at the center part and 83.2 percent by mass at the contour part, indicating that the percentage of Fe at the contour part was lower than that at the center part by 15.5 percent by mass. Also, Si and Cr were contained by 1.1 percent by mass and 0.2 percent by mass, respectively, at the center part, while Si and Cr were contained by 13.1 percent by mass and 3.7 percent by mass, respectively, at the contour part.

Comparative Example 1

The metal magnetic powder pertaining to Comparative Example 1 was obtained according to the same method used in Example 1, except that the oxygen concentration in the vacuum heat treatment furnace was set to 100 ppm, the holding temperature during heat treatment was set to 800° C., and the heat treatment was followed by furnace cooling to near room temperature without operating the rapid cooling mechanism of the vacuum heat treatment furnace.

Figure 8:
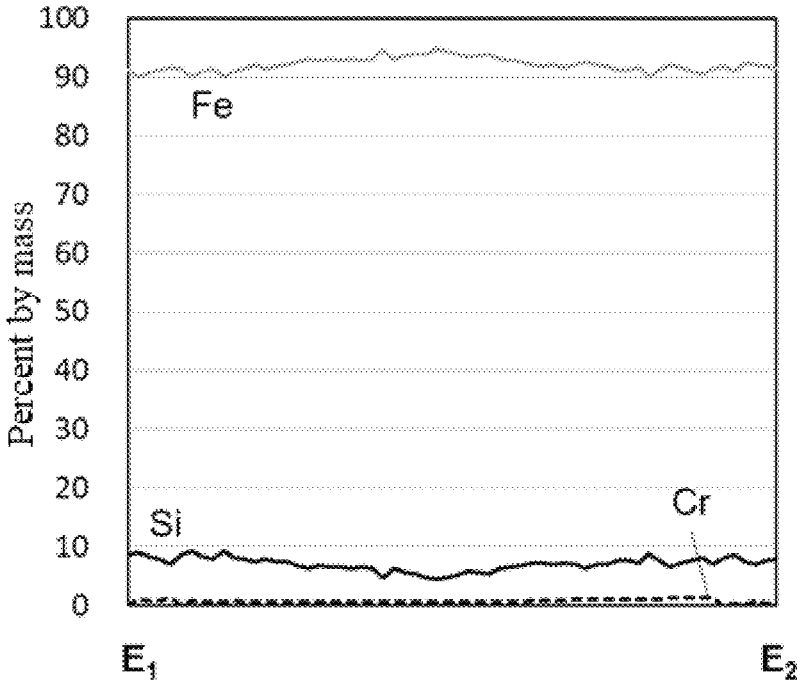
FIG. 8 is a graph obtained from line analysis of a cross-section of a metal magnetic grain constituting the metal magnetic powder pertaining to Comparative Example 1, showing the distributions of elements in the metal phase.

When this metal magnetic powder was observed with a STEM according to the same method used in Example 1, it was confirmed that the observation target grain had its metal phase covered with an oxide film. A line analysis was performed on this metal phase of the observation target grain according to the same method used in Example 1, to calculate the content percentages of metal elements at each measurement point. The obtained results are shown in FIG. 8 as metal element distributions in the metal phase.

From the obtained metal element distributions, the mass percentages of each element at the center part and contour part of the metal phase were calculated according to the same method used in Example 1. The mass percentage of Fe at the center part was 94.5 percent by mass, which was lower than that of the material powder. On the other hand, the mass percentage of Fe at the contour part was 90.8 percent by mass. Also, Si and Cr were contained by 4.8 percent by mass and 0.7 percent by mass, respectively, at the center part, while Si and Cr were contained by 8.3 percent by mass and 0.9 percent by mass, respectively, at the contour part.

From these results, it is clear that heat-treating under specific conditions a material powder for metal magnetic material whose Fe content is 90 to 99 percent by mass and which contains at least one type of element M, allows metal magnetic grains to be formed that have a structure of an oxide film covering a metal phase whose center part has an extremely high percentage of Fe while contour part has a relatively low percentage of Fe. It is also clear that, in these metal magnetic grains, the percentages of elements other than Fe are higher at the contour part than the center part. Because parts where the percentage of each element is different exist across the metal magnetic grains from the surface to the inside, as described above, the metal magnetic powder constituted by these metal magnetic grains can provide a magnetic body offering excellent magnetic properties.

INDUSTRIAL APPLICABILITY

According to the present invention, a metal magnetic powder can be provided that, despite a high content percentage of Fe in the metal phase inside the metal magnetic grain, inhibits oxidation of the contained Fe to allow a magnetic body offering excellent magnetic properties to be obtained. The present invention is useful in that, by utilizing this powder, a magnetic body offering excellent magnetic properties such as saturation magnetic flux density and magnetic permeability can be obtained, which in turn allow for performance improvement or size reduction of a coil component comprising this magnetic body.

I claim:

1. A metal magnetic powder constituted by metal magnetic grains, each comprising:

a metal phase where a mass percentage of Fe relative to all metal elements contained at its center part is 98 percent or higher, and a mass percentage of Fe relative to all metal elements contained at its contour part is lower than that at the center part, said metal phase being a part of each magnetic grain where an oxygen abundance ratio is 15 atomic percent or lower; and an oxide film covering the metal phase, wherein the metal phase further contains at least one type of element selected from Si, Cr, Al, Ti, Zr, and Mg.

2. The metal magnetic powder according to claim 1, wherein the percentage of Fe at the contour part is lower by 1 to 20 percent by mass than that at the center part.

3. The metal magnetic powder according to claim 1, wherein the percentage of Fe at the contour part is lower by 5 to 18 percent by mass than that at the center part.

4. The metal magnetic powder according to claim 1, wherein the percentage of Fe at the contour part is 80 to 85 percent by mass.

5. The metal magnetic powder according to claim 1, wherein a total of percentages of Si, Cr, Al, Ti, Zr, and Mg at the contour part is higher by at least 5 percent by mass than a total of corresponding percentages at the center part.

6. The metal magnetic powder according to claim 1, wherein a part containing more Fe than a total of mass percentages of Si, Cr, Al, Ti, Zr, and Mg is formed in the oxide film.

7. A coil component, comprising:

a magnetic body in which metal magnetic grains constituting the metal magnetic powder according to claim 1 are joined together via a resin or oxide; and conductors placed inside, or on a surface of, the magnetic body.

8. A circuit board on which the coil component according to claim 7 is installed.

9. The metal magnetic powder according to claim 1, wherein a total of percentages of Si, Cr, Al, Ti, Zr, and Mg at the contour part is higher than a total of corresponding percentages at the center part, and a total of corresponding percentages at an intermediate part located between the center part and the contour part in a radial direction of each magnetic grain is between the total of corresponding percentages at the center part and the total of corresponding percentages at the contour part.

* * * * *